US008546317B2

(12) United States Patent
Mertens et al.

(10) Patent No.: US 8,546,317 B2
(45) Date of Patent: Oct. 1, 2013

(54) HARD SURFACE CLEANING COMPOSITION

(75) Inventors: Annick Julia Oscar Mertens, Bornem (BE); Geert Andre Deleersnyder, Wielsbeke (BE); Patrick Firmin August Delplancke, Steenhuize-Wijnhuize (BE); Stefano Scialla, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 201 days.

(21) Appl. No.: 12/833,492

(22) Filed: Jul. 9, 2010

(65) Prior Publication Data

US 2011/0009309 A1 Jan. 13, 2011

(30) Foreign Application Priority Data

Jul. 8, 2009 (EP) ..... 09164872

(51) Int. Cl.
*C11D 1/00* (2006.01)

(52) U.S. Cl.
USPC ..... 510/238; 510/434; 510/475; 510/490; 510/492; 510/494

(58) Field of Classification Search
None
See application file for complete search history.

(56) References Cited

U.S. PATENT DOCUMENTS

| | | | |
|---|---|---|---|
| 2,082,275 | A | 6/1937 | Daimler et al. |
| 2,255,082 | A | 9/1941 | Orthner et al. |
| 2,438,091 | A | 3/1948 | Lynch |
| 2,528,378 | A | 10/1950 | Mannheimer |
| 2,658,072 | A | 11/1953 | Kosmin et al. |
| 2,702,279 | A | 2/1955 | Funderburk et al. |
| 3,586,715 | A | 6/1971 | Smeets |
| 3,812,044 | A | 5/1974 | Connor et al. |
| 3,929,678 | A | 12/1975 | Laughlin et al. |
| 4,565,647 | A | 1/1986 | Llenado |
| 4,704,233 | A | 11/1987 | Hartman et al. |
| 5,776,872 | A | 7/1998 | Giret et al. |
| 5,883,062 | A | 3/1999 | Addison et al. |
| 5,906,973 | A | 5/1999 | Ouzounis et al. |

FOREIGN PATENT DOCUMENTS

| | | | |
|---|---|---|---|
| JP | 11349826 | A | 12/1999 |
| WO | WO98/36046 | * | 8/1998 |
| WO | WO01/38480 | * | 5/2001 |
| WO | WO2007/068744 | * | 6/2007 |

OTHER PUBLICATIONS

Gauthier, et al., Sulfobetaine Zwitterionomers Based on n-Butyl Acrylate and 2-Ethoxyethyl Acrylate: Monomer Synthesis and Copolymerization Behavior, Journal of Polymer Science: Part A: Polymer Chemistry, 2002, pp. 511-523; vol. 40.

Lee, et al., Synthesis and solubility of the poly(sulfobetaine)s and the corresponding cationic polymers: 1. Synthesis and characterization of sulphobetaines and the corresponding cationic monomers by nuclear magnetic resonance spectra, POLYMER, 1994, pp. 2210-2217, vol. 35, No. 10.

Soto, et al., Poly(sulphopropylbetaines): 1. Synthesis and characterization, POLYMER, 1984, pp. 121-128, vol. 25.

Köberle, et al., Hydrophobically Modified Zwitterionic Polymers: Synthesis, Bulk Properties, and Miscibility with Inorganic Salts, Macromolecules, 1994, pp. 2165-2173, vol. 27.

Castaño, et al., Evidence of ionic aggregates in some ampholytic polymers by transmission electron microscopy, J. Mater. Res., Mar. 1990, pp. 654-657, vol. 5, No. 3.

Salamone, et al., Aqueous solution properties of a poly(vinyl imidazolium sulphobetaine), POLYMER, Oct. 1978, pp. 1157-1162, vol. 19.

Favresse, et al., New poly(carbobetaine)s made from zwitterionic diallylammonium monomers, Macromolecular Chemistry and Physics, 1999, pp. 887-895, vol. 200, No. 4.

Berlinova, et al., Synthesis and aqueous solution behaviour of copolymers containing sulfobetaine moieties in side chains, POLYMER, 2000, pp. 831-837, vol. 41.

Lee, et al., Poly(sulfobetaine)s and corresponding cationic polymers: 3. Synthesis and dilute aqueous solution properties of poly(sulfobetaine)s derived from styrene-maleic anhydride, Polymer, 1997, pp. 971-979, vol. 38, No. 4.

Lee, et al., Poly(sulfobetaine)s and Corresponding Cationic Polymers. VIII. Synthesis and Aqueous Solution Properties of a Cationic Poly(methyl iodide quaternized styrene-N, N-dimethylaminopropyl maleamidic acid) Copolymer, Journal of Applied Polymer Science, 2001, pp. 1619-1626, vol. 80.

Lowe, et al., Synthesis of polybetaines with narrow molecular mass distribution and controlled architecture, Chem. Commun., 1996, pp. 1555-1556.

Lowe, et al., Synthesis and Properties of Low-Polydispersity Poly(sulfopropylbetaine)s and Their Block Copolymers, Macromolecules, 1999, pp. 2141-2148, vol. 32.

* cited by examiner

*Primary Examiner* — Necholus Ogden, Jr.
(74) *Attorney, Agent, or Firm* — John T. Dipre; Amy I. Ahn-Roll

(57) ABSTRACT

The present invention relates to a hard surface cleaning composition comprising a polybetaine polymer, wherein said polybetaine polymer comprises a zwitterionic unit A or a mixture thereof, wherein said unit A comprises a betaine group or a mixture thereof and wherein said betaine group of said unit A is a sulphobetaine group or a mixture thereof, and a vinylpyrrolidone homopolymer or copolymer, wherein said polybetaine polymer and said vinylpyrrolidone homopolymer or copolymer are present in said composition at a weight ratio of polybetaine polymer to vinylpyrrolidone homopolymer or copolymer of at utmost 1.5:1.

9 Claims, No Drawings

HARD SURFACE CLEANING COMPOSITION

FIELD OF THE INVENTION

The present invention relates to a composition for cleaning a hard surface and a process of cleaning a hard surface with such a composition. The hard surface cleaning composition herein comprises a polybetaine polymer as defined herein below and a vinylpyrrolidone homopolymer or copolymer, at a certain weight ratio.

BACKGROUND OF THE INVENTION

Compositions for cleaning hard surfaces are well known in the art. Manufacturers of such hard surface cleaning compositions are continuously searching for new components that will improve the effectiveness of the compositions. The present invention relates to a new technology for use in cleaning of hard surfaces such as floors, tiles, work surfaces, ceramic surfaces, windows, blinds, shades, mirrors, household appliances, etc.

In hard surface cleaning applications, the resulting appearance of the hard surface after the hard surface cleaning is of high relevance. Indeed, such a hard surface cleaning application has not only to provide a clean surface but the hard surface should have a shiny appearance. In addition, providing the hard surface with soil repellency properties, meaning the prevention or at least reduction of deposition of soil after an initial cleaning operation, is a desired property. Moreover, providing a next time cleaning benefit, wherein the subsequent cleaning of an initially cleaned surface is facilitated, is desired. There is also the need to provide a fast-drying benefit on inclined or vertical hard surfaces.

Polyvinylpyrrolidone homo- and co-polymers have been used in hard surface cleaning composition to provide fast-drying benefits especially on inclined or vertical hard surfaces. However, with regard to currently marketed hard surface cleaning compositions, it has been found that the performance with regard to shine of such compositions used in hard surface cleaning applications may still be further improved. Furthermore, it has been found that the performance with regard to soil repellency and next time cleaning of such compositions used in hard surface cleaning applications may also still be further improved.

Thus, the objective of the present invention is to provide a hard surface cleaning composition exhibiting good shine performance and/or good soil repellency performance and/or good next time cleaning benefit performance whilst at the same time showing a good fast-drying performance on inclined or vertical hard surfaces.

It has now been found that this objective can be met by a hard surface cleaning composition as described herein as well as a process of cleaning a hard surface as described herein.

Advantageously, the composition and process as described herein provide good cleaning performance.

A further advantage of the present invention is that the composition and process herein may be used to clean hard surfaces made of a variety of materials like glazed and non-glazed ceramic tiles, enamel, stainless steel, Inox®, Formica®, vinyl, no-wax vinyl, linoleum, melamine, glass, plastics and plastified wood.

SUMMARY OF THE INVENTION

The present invention relates to a hard surface cleaning composition comprising a polybetaine polymer, wherein said polybetaine polymer comprises a zwitterionic unit A or a mixture thereof, wherein said unit A comprises a betaine group or a mixture thereof and wherein said betaine group of said unit A is a sulphobetaine group or a mixture thereof, and a vinylpyrrolidone homopolymer or copolymer, wherein said polybetaine polymer and said vinylpyrrolidone homopolymer or copolymer are present in said composition at a weight ratio of polybetaine polymer to vinylpyrrolidone homopolymer or copolymer of at utmost 1.5:1.

In an alternative embodiment, the present invention encompasses a process of cleaning a hard surface with a hard surface cleaning composition according to the present invention.

In another alternative embodiment, the present invention also encompasses the use of a polybetaine polymer, wherein said polybetaine polymer comprises a zwitterionic unit A or a mixture thereof, wherein said unit A comprises a betaine group or a mixture thereof and wherein said betaine group of said unit A is a sulphobetaine group or a mixture thereof, and a vinylpyrrolidone homopolymer or copolymer, in a hard surface cleaning composition, wherein good shine and/or good soil repellency and/or good next time cleaning benefit are provided whilst also a good fast-drying performance on inclined or vertical surfaces is achieved.

DETAILED DESCRIPTION OF THE INVENTION

Hard Surface Cleaning Composition

The composition herein may be either a liquid composition or a solid composition. Liquid compositions include gels, pastes, thickened liquid compositions as well as compositions having a water-like viscosity. Solid compositions herein include powders, pellets, bars, and the like. Furthermore, the composition herein may also be a unit-dose hard surface cleaning composition such as a tablet or a water soluble pouch comprising one or more compartments filled with a liquid or a solid composition or a combination thereof. In a preferred embodiment according to the present invention, the hard surface cleaning composition herein is a liquid hard surface cleaning composition.

A preferred liquid hard surface cleaning composition herein is an aqueous, liquid hard surface cleaning composition and therefore, preferably comprises water more preferably in an amount of from 50% to 98%, even more preferably of from 75% to 97% and most preferably 80% to 97% by weight of the total composition.

Preferred liquid hard surface cleaning composition herein have a viscosity of 1 cps or greater, more preferably of from 1 to 20000 cps, and still more preferably of from 1 to 500 cps at 20° C. when measured with a TA instrument Advanced Rheometer AR 1000 with coned spindle 2° at 10/sec.

The pH of the liquid hard surface cleaning composition according to the present invention may typically be from 0 to 14.

In a preferred embodiment, the liquid hard surface cleaning composition herein is a neutral to alkaline composition, preferably an alkaline composition. Indeed, the pH of the liquid hard surface cleaning composition herein is from 7 to 14, preferably from 7.1 to 14, more preferably from 7.1 to 13, even more preferably from 7.1 to 12 and most preferably from 8.0 to 11. Indeed, it has been surprisingly found that the greasy cleaning performance is further improved at these preferred alkaline to neutral pH ranges, preferably alkaline pH ranges. Accordingly, the liquid hard surface cleaning composition herein may further comprise an acid or base (as described herein below) to adjust pH as appropriate, preferably a base.

In another preferred embodiment, the liquid hard surface cleaning composition herein is a acidic to neutral composition, preferably an acidic composition. Indeed, the pH of the liquid hard surface cleaning composition herein is from 0 to 7, preferably from 0 to 6.9, more preferably from 0.5 to 6, even more preferably from 1 to 5, and most preferably from 2 to 5. Indeed, it has been surprisingly found that cleaning performance, especially on limescale-containing soils, such as limescale and/or hard water marks or greasy soap scum, is further improved at these preferred acidic to neutral pH ranges, preferably acidic pH ranges. Accordingly, the liquid hard surface cleaning composition herein may further comprise an acid or base (as described herein below) to adjust pH as appropriate, preferably an acid.

In the preferred embodiment herein, wherein the hard surface cleaning composition herein is a solid composition or contains a solid component (such as for water soluble pouches containing at least one solid component), the solid hard surface cleaning composition herein may further comprise an acid or base (as described herein below) to adjust the pH.

A suitable acid for use herein is an organic and/or an inorganic acid. A preferred organic acid for use herein has a pKa of less than 6. A suitable organic acid is selected from the group consisting of citric acid, lactic acid, formic acid, glycolic acid, succinic acid, glutaric acid and adipic acid and a mixture thereof. A mixture of said acids may be commercially available from BASF under the trade name Sokalan® DCS. A suitable inorganic acid is selected from the group consisting hydrochloric acid, sulphuric acid, phosphoric acid and a mixture thereof.

A typical level of such an acid, when present, is of from 0.01% to 20%, preferably from 0.04% to 15% and more preferably from 0.05% to 10% by weight of the total composition.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (as e.g. monoethanolamine or triethanolamine).

Typical levels of such bases, when present, are of from 0.01% to 5.0%, preferably from 0.05% to 3.0% and more preferably from 0.1% to 2% by weight of the total composition.

Process of Cleaning a Hard Surface

The present invention encompasses a process of cleaning a hard surface with a composition according to the present invention. In a preferred embodiment, the process of cleaning a hard surface herein involves the use of the hard surface cleaning composition according to the present invention in liquid form. By "in liquid form" it is meant herein, the liquid hard surface cleaning composition (as described herein above) either in its neat or diluted form (see herein below) or the solid or unit-dose hard surface cleaning composition (both as described herein above) in dissolved form.

In a preferred embodiment said hard surface is contacted with the hard surface cleaning composition according to the present invention.

By "hard surface", it is meant herein any kind of surface typically found in houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, any plastics, plastified wood, metal or any painted or varnished or sealed surface and the like. Hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

Furthermore, hard surfaces herein also include hard surfaces of cars and other automotive vehicles.

In a preferred embodiment according to the present invention, the hard surface to be cleaned in the process herein is selected from the group consisting of ceramic, glass, enamel, stainless steel, chromed, and plastic surfaces and Formica®. Preferably, the hard surface to be cleaned in the process herein is selected from the group consisting of bathroom hard surfaces preferably selected from the group consisting of: ceramic, glass, enamel, stainless steel, plastic and chromed surfaces.

In a preferred embodiment of the present invention said hard surface is inclined or vertical. Inclined or vertical hard surfaces include mirrors, lavatory pans, urinals, drains, side wall of bathtubs and shower stalls, waste pipes and the like. Such vertical or inclined surfaces can often be found in bathrooms.

A preferred embodiment of the present invention provides that a liquid hard surface cleaning composition is applied onto the surface to be treated. The composition may be in its neat form or in its diluted form.

By "diluted form", it is meant herein that said liquid composition is diluted by the user typically with water. The liquid composition is diluted prior to use to a typical dilution level of 10 to 400 times its weight of water, preferably from 10 to 200 and more preferably from 10 to 100. A usually recommended dilution level is a 1-1.5% dilution of the composition in water.

By "in its neat form", it is to be understood that said liquid composition is applied directly onto the surface to be treated without undergoing any dilution, i.e., the liquid composition herein is applied onto the hard surface as described herein.

An alternative preferred embodiment of the present invention provides that a solid or unit-dose hard surface cleaning composition is applied onto the surface to be treated. The composition is in its dissolved form.

By "dissolved form", it is meant herein that said solid or unit-dose hard surface cleaning composition is dissolved by the user typically in water. The solid or unit-dose hard surface cleaning composition is dissolved prior to use to a typical dissolution level of 10 to 400 times its weight in water, preferably from 10 to 200 and more preferably from 10 to 100. A usually recommended dissolution level is a 1-1.5% dissolution by weight of the composition in water.

In the process herein, the hard surface cleaning composition herein is applied onto said surface by conventional means known by the skilled person. Indeed, the composition herein may be applied by pouring or spraying said composition, preferably in liquid form, onto said surface. In a preferred embodiment, the process of cleaning a hard surface herein includes the steps of applying, preferably spraying, said hard surface cleaning composition, preferably in liquid form, onto said hard surface, leaving said hard surface cleaning composition to act onto said surface for a period of time to allow said composition to act, preferably without applying mechanical action, and optionally removing said hard surface cleaning composition, preferably removing said hard surface cleaning composition by rinsing said hard surface with water and/or wiping said hard surface with an appropriate instrument, e.g., a sponge, a paper or cloth towel and the like.

In a highly preferred embodiment of the present invention the liquid hard surface cleaning composition herein is sprayed onto said hard surface. More preferably, said liquid hard surface cleaning composition is sprayed in its neat form onto said hard surface.

In another preferred process of cleaning a hard surface according to the present invention, said hard surface cleaning composition is applied onto said surface in diluted form without rinsing the hard-surface after application in order to obtain good soil/stain removal performance.

Alternatively, the hard surface cleaning composition herein may be applied using an appropriate implement, such as a mop or a cloth, soaked in the diluted composition herein. Furthermore, once applied onto said surface said composition may be agitated over said surface using an appropriate implement. Indeed, said surface may be wiped using a mop or a cloth. During such a cleaning operation parts of the composition herein may be captured in the cleaning implement, if any, (preferably in combination with soil initially present on the surface) and transferred into a bucket or another suitable receptacle (squeezing of the mop or cloth), another part of the composition will be left on the surface after the cleaning operation. Indeed, the composition is, preferably at least partially, left on said surface at the end of said process of cleaning said hard surface, more preferably left on said surface until the next cleaning operation and still more preferably at least partially left on said surface until the next cleaning operation. In a preferred embodiment herein the process of cleaning a hard surface according to the present invention, the composition is applied onto said surface in diluted form without rinsing said hard surface after application. Indeed, the composition is (at least partially) left to dry on said hard surface. However, the hard surface cleaned with the process according to the present invention may eventually be rinsed during a subsequent cleaning process. Furthermore, due to normal use of the hard surfaces cleaned by the process herein, said hard surfaces may eventually be wetted, by for example by spilling water or other liquids onto said surface. Such subsequent cleaning processes or the accidental wetting of the hard surface shall not be considered as rinsing of the surface within the meaning of the present invention. Moreover, the removal of parts of the composition applied onto the hard surface during the cleaning, e.g., be means of squeezing soiled composition out of a mop or cloth shall not be considered as rinsing of the surface within the meaning of the present invention By "rinsing", it is meant herein contacting the hard surface cleaned with the process according to the present invention with substantial quantities of appropriate solvent, typically water, directly after the step of applying the liquid composition herein onto said hard surface. By "substantial quantities", it is meant herein between 0.01 lt. and 1 lt. of water per $m^2$ of hard surface, more preferably between 0.1 lt. and 1 lt. of water per $m^2$ of hard surface.

The hard surfaces to be treated may be soiled with a variety of soils, e.g., greasy soils (e.g., greasy soap scum, body grease, kitchen grease or burnt/sticky food residues typically found in a kitchen and the like), particulate greasy soils or so called "limescale-containing stains". By "limescale-containing stains" it is meant herein any pure limescale stains, i.e., any stains composed essentially of mineral deposits, as well as limescale-containing stains, i.e., stains which contain not only mineral deposits like calcium and/or magnesium carbonate but also soap scum (e.g., calcium stearate) and other grease (e.g. body grease).

In an alternative embodiment herein, the liquid hard surface cleaning composition herein is impregnated onto a substrate, preferably a nonwoven substrate, to form a premoistened hard surface cleaning wipe. Indeed, the process of cleaning a hard surface according to the present invention preferably comprises the steps of contacting a premoistened hard surface cleaning wipe comprising the liquid hard surface cleaning composition herein impregnated onto a substrate with said hard surface and more preferably wiping said hard surface with said wipe.

Polybetaine Polymer

Definitions

By "a sulphobetaine group" it is meant herein, a group comprising an anionic group and a cationic group, with at least one of the groups containing a sulphur atom.

By "unit derived from a monomer" it is meant herein, the different units of the $A_{precursor}$ units, to denote a unit which may be obtained directly from said monomer through polymerisation. Indeed, a unit deriving from an acrylic or methacrylic acid ester does not cover a unit with formula —$CH_2$—CH(COOH)—, —$CH_2$—C($CH_3$)(COOH)—, —$CH_2$—CH(OH)—, respectively, obtained by polymerizing an acrylic or methacrylic acid ester or a vinyl acetate ester respectively, then hydrolyzing, for example. A unit deriving from acrylic or methacrylic acid covers, for example, a unit obtained by polymerizing a monomer (for example an acrylic or methacrylic acid ester), then making the obtained polymer react (for example by hydrolysis) so as to obtain units with formula —$CH_2$—CH(COOH)—, or —$CH_2$—C($CH_3$)(COOH)—. A unit deriving from a vinyl alcohol covers, for example, a unit obtained by polymerizing a monomer (for example a vinyl ester), then making the obtained polymer react (for example by hydrolysis) so as to obtain units with formula —$CH_2$—CH(OH)—. Units deriving from an A monomer may have been obtained, for example, through polymerisation of $A_{precursor}$ monomers, then post-polymerisation reaction to obtain units comprising the betaine group. The A units are not considered units deriving from $A_{precursor}$ monomers not containing the betaine group.

By "molar mass" it is meant herein unless otherwise stated, the average molar mass in absolute mass, expressed in g/mol. This can be determined by permeation chromatography of aqueous gel (GPC), by light diffusion (DDL or MALLS for an aqueous solvent), with an aqueous solvent or an organic solvent (for example formamide), according to the composition of the polymer.

Unless otherwise stated, the quantities and proportions herein are indicated in active matter (as opposed to diluted or dispersed matter) and in weight.

Polybetaine Polymer

The polybetaine polymer according to the present invention comprises a zwitterionic unit A or a mixture thereof, wherein unit A comprises a betaine group or a mixture thereof characterised by:

the betaine group of the unit A being a sulphobetaine group or a mixture thereof.

In a preferred embodiment herein, the polybetaine polymer according to the present invention is a homopolymer.

In another preferred embodiment herein, the polybetaine polymer according to the present invention is a copolymer of a mixture of units A.

In another preferred embodiment herein, the polybetaine polymer according to the present invention is a copolymer of a unit A or mixtures thereof and:

a unit B being at least one hydrophilic monomer carrying a functional acidic group which is copolymerizable with unit A and which is capable of being ionized in the application medium;

and optionally a unit C being at least one monomer compound with ethylenic unsaturation with a neutral charge which is copolymerizable with units A and B, preferably a hydrophilic monomer compound with ethylenic unsaturation with a neutral charge, carrying one or more hydrophilic groups, which is copolymerizable with units A and B.

In the preferred embodiment herein, wherein the polybetaine polymer herein is a copolymer comprising units other than units A, the units A, B, as well as possibly with other optional units, form a polyalkylene hydrocarbon chain possibly broken by one or more nitrogen or sulphur atoms.

In the preferred embodiment herein, wherein the polybetaine polymer herein is a copolymer, it preferably is a statistical copolymer.

Units A Containing a Sulphobetaine Group

The betaine group of the units A contains an anionic group and a cationic group, with at least one of the groups containing a sulphur atom. The anionic group may be a carbonate group, a sulphuric group such as a sulphonate group, a phosphorus group such as a phosphate, phosphonate, phosphinate group, or an ethanolate group. It is preferably a sulphuric group. The cationic group may be an onium or inium group from the nitrogen, phosphate or sulphur family, for example an ammonium, pyridinium, imidazolinimum, phosphonium or sulphonium group. It is preferably an ammonium group (preferably quaternary). Preferably, the betaine group is a sulphobetaine group containing a sulphonate group and a quaternary ammonium group. The present invention encompasses copolymers containing different betaine groups as units A in the copolymer.

The betaine groups are typically the pendant groups of the polybetaine polymer herein, typically obtained from monomers containing at least one ethylene non-saturation.

At the core of the units A, the number of positive charges is equal to the number of negative charges. The units A are electrically neutral, in at least one pH range.

Useful betaine groups may be represented, in case of cations from the nitrogen family, by the following formulae (I) to (IV), having a cationic charge at the centre of the function and an anionic charge at the end of the function:

$$—N^{(+)}(R^1)(R^2)—R\text{-}A\text{-}O^{(-)} \quad (I)$$

$$—(R^3)C{=}N^{(+)}(R^4)—R\text{-}A\text{-}O^{(-)} \quad (II)$$

$$—(R^3)(R)C—N^{(+)}(R^4)(R^5)—R\text{-}A\text{-}O^{(-)} \quad (III)$$

$$—N^{(+)}({=}R^6)—R\text{-}A\text{-}O^{(-)} \quad (IV)$$

wherein:

$R^1$, $R^2$ and $R^5$, are similar or different, and represent an alkyl radical containing 1 to 7 carbon atoms, preferably 1 to 2.

$R^3$ et $R^4$, are similar or different, and represent hydrocarbon radicals forming, with the nitrogen atom, a nitrogen heterocycle comprising possibly one or more other heteroatoms, preferably nitrogen $R^6$ represents a hydrocarbon radical forming, with the nitrogen atom, a saturated or unsaturated nitrogen heterocycle, comprising possibly one or more other heteroatoms, preferably nitrogen.

R represents a linear or branched alkylene radical comprising 1 to 15 carbon atoms, preferably 2 to 4, possibly substituted by one or more hydroxy groups, or a benzylene radical, A represents S(=O)(=O).

Useful betaine groups may be represented, in case of cations from the phosphorus family, are represented by formula (VI):

$$—P^{(+)}(R^1)(R^2)—R\text{-}A\text{-}O^{(-)} \quad (VI)$$

wherein $R^1$, $R^2$, R and A have the definition stated above.

Useful betaine groups may be represented, in case of cations from the sulphur family, are represented by formulae (VIII) and (IX):

$$—S^{(+)}(R^1)—R\text{-}A\text{-}O^{(-)} \quad (VIII)$$

$$—R\text{-}A'(\text{-}O^{(-)})—R—S^{(+)}(R^1)(R^2) \quad (IX)$$

wherein for formula (VIII):

$R^1$ and R have the definition stated above,

A represents S(=O)(=O), OP(=O)(=O), OP(=O)(OR'), P(=O)(OR') or P(=O)(R'),

R represents an alkyl radical containing 1 to 7 carbon atoms or a phenyl radical or wherein for formula (IX):

$R^1$, $R^2$ and R have the definition stated above, and

A' represents —O—P(=O)—O—.

The betaine groups may be connected to the carbon atoms of a macromolecular chain derived from the polymerisation of an ethylene non-saturation (dorsal, skeleton) of the polymer by the intermediary, namely of a bivalent or polyvalent hydrocarbon pattern (for example alkylene or arylene), possibly broken by one or several heteroatoms, namely of oxygen or nitrogen, an ester pattern, an amide pattern, or even by a valency link.

The polybetaine polymer herein may be obtained by radical polymerisation: of monomers A comprising an ethylenically unsaturated betaine group, namely of ethylenically unsaturated monomers containing at least one betaine group with the above formulae, and optionally monomers B and C.

Said monomers A are for example:

one or more mono- or poly-ethylenically unsaturated hydrocarbon radicals (namely vinyl, allyl, styrenyl, and the like), one or more mono- or poly-ethylenically unsaturated ester radicals (namely acrylate, methacrylate, maleate, and the like) and/or one or more mono- or poly-ethylenically unsaturated amide radicals (namely acrylamido, methacrylamido, and the like)

The units A may derive from at least one betaine monomer A selected from group consisting of the following monomers:

alkylsulphonates of dialkylammonium alkyl acrylates or methacrylates, acrylamido or methacrylamido, such as: sulphopropyl dimethyl ammonium ethyl methacrylate, marketed by RASCHIG under the name SPE:

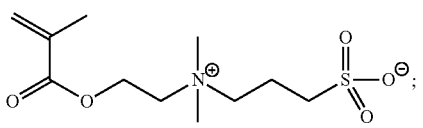

(SPE)

sulphoethyl dimethyl ammonium ethyl methacrylate and sulphobutyl dimethyl ammonium ethyl methacrylate:

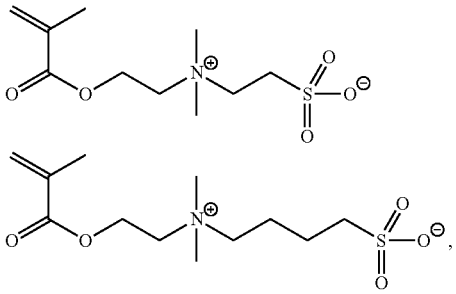

whose synthesis is described in the article "Sulfobetaine Zwitterionomers based on n-butyl acrylate and 2-Ethoxyethyl acrylate: monomer synthesis and copolymerization behaviour", Journal of Polymer Science 40, 511-523 (2002);

sulfohydroxypropyl dimethyl ammonium ethyl methacrylate:

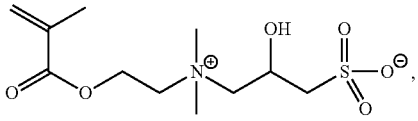

(SHPE)

sulphopropyl dimethylammonium propyl acrylamide:

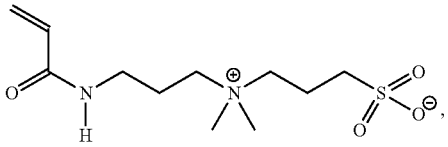

whose synthesis is described in the article "Synthesis and solubility of the poly(sulfobetaine)s and the corresponding cationic polymers: 1. Synthesis and characterization of sulphobetaines and the corresponding cationic monomers by nuclear magnetic resonance spectra", Wen-Fu Lee and Chan-Chang Tsai, Polymer, 35 (10), 2210-2217 (1994), sulphopropyl dimethylammonium propyl methacrylamide, marketed by RASCHIG under the name SPP:

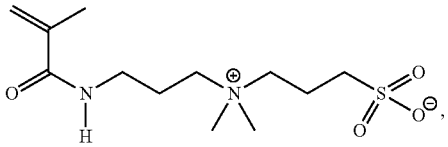

(SPP)

sulphopropyl dimethylammonium ethyl methacrylate, marketed by RASCHIG under the name SPDA:

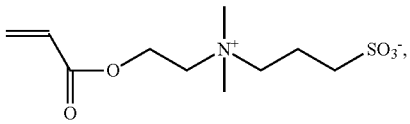

(SPDA)

sulphohydroxypropyl dimethyl ammonium propyl methacrylamido:

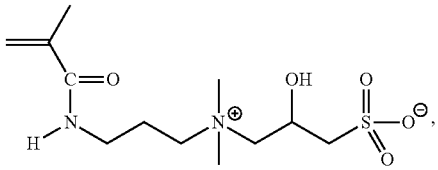

(SHPP)

sulphopropyl diethyl ammonium ethyl methacrylate:

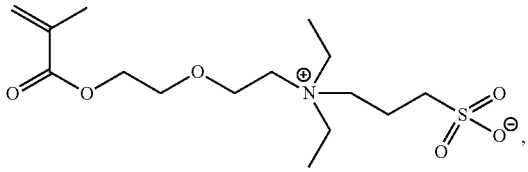

whose synthesis is described in the article "Poly(sulphopropylbetaines): 1. Synthesis and characterization", V. M. Monroy Soto and J. C. Galin, Polymer, 1984, Vol 25, 121-128, sulphohydroxypropyl diethyl ammonium ethyl methacrylate:

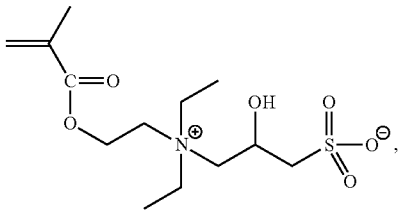

heterocyclic betaine monomers, such as:

sulphobetaines derived from piperazine:

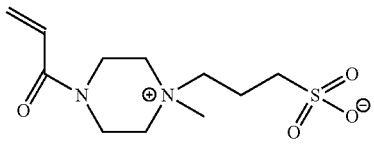

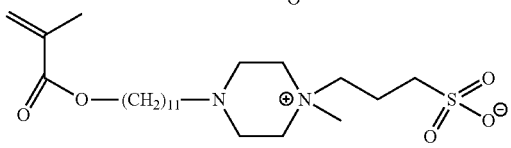

-continued

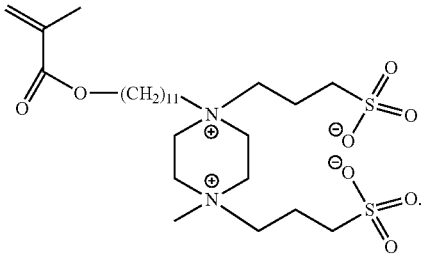

whose synthesis is described in the article "Hydrophobically Modified Zwitterionic Polymers: Synthesis, Bulk Properties, and Miscibility with Inorganic Salts", P. Koberle and A. Laschewsky, Macromolecules 27, 2165-2173 (1994), sulphobetaines derived from 2-vinylpyridine and 4-vinylpyridine, such as:

the 2-vinyl (3-sulphopropyl)pyridinium betaine (2SPV or "SPV"), marketed by RASCHIG under the name SPV,

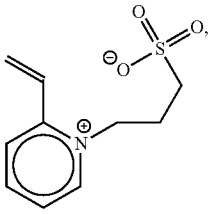

(SPV)

the 4-vinyl (3-sulphopropyl)pyridinium betaine (4SPV) whose synthesis is described in the article "Evidence of ionic aggregates in some ampholytic polymers by transmission electron microscopy", V. M. Castaño and A. E. González, J. Cardoso, O. Manero and V. M. Monroy, J. Mater. Res., 5 (3), 654-657 (1990):

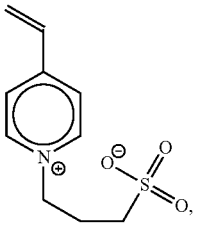

(4SPV)

the 1-vinyl-3-(3-sulphopropyl) imidazolium betaine:

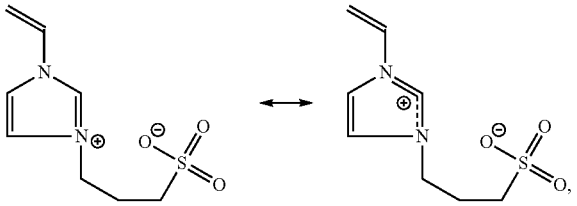

whose synthesis is described in the article "Aqueous solution properties of a poly(vinyl imidazolium sulphobetaine)", J. C. Salamone, W. Volkson, A. P. Oison, S. C. Israel, Polymer, 19, 1157-1162 (1978)

alkylsulphonates of dialkylammonium alkyl allyl, such as sulphopropyl methyl diallyl ammonium betaine:

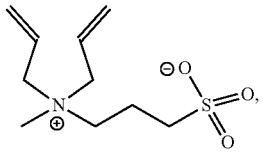

whose synthesis is described in the article "New poly(carbobetaine)s made from zwitterionic diallylammonium monomers", Favresse, Philippe; Laschewsky, Andre, Macromolecular Chemistry and Physics, 200(4), 887-895 (1999), styrene alkylsulphonates of dialkylammonium alkyl, such as:

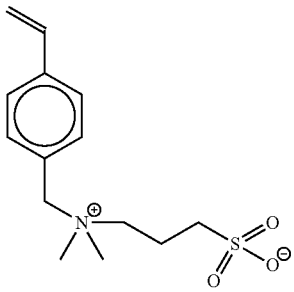

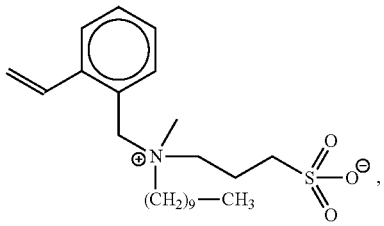

whose synthesis is described in the article "Hydrophobically Modified Zwitterionic Polymers: Synthesis, Bulk Properties, and Miscibility with Inorganic Salts", P. Koberle and A. Laschewsky, Macromolecules 27, 2165-2173 (1994), betaines from dienes and ethylenically unsaturated anhydrides, such as:

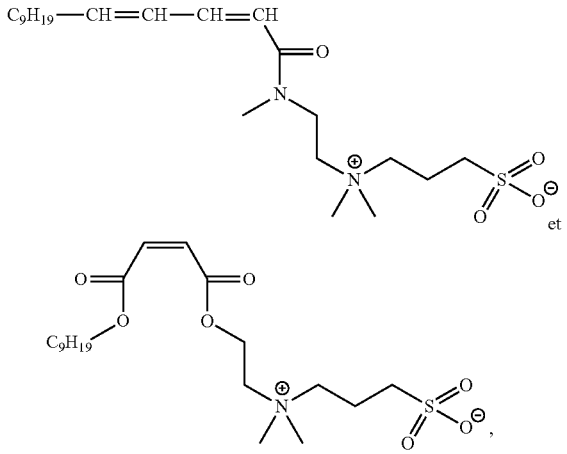

whose synthesis is described in the article "Hydrophobically Modified Zwitterionic Polymers: Synthesis, Bulk Properties, and Miscibility with Inorganic Salts", P. Koberle and A. Laschewsky, Macromolecules 27, 2165-2173 (1994), betaines from cyclic acetals, preferably ((dicyanoethanolate) ethoxy)dimethyl ammonium propyl methacrylamide.

The polybetaine polymer according to the present invention, can also be obtained in a known method by chemically modifying a polymer (copolymer) called precursor polymer, containing the $A_{precursor}$ units, which are modified (botanized) by a post-polymerisation reaction to achieve the units A being a betaine group. Sulphobetaine units can thus be obtained by chemically modifying precursor polymer units, preferably by chemically modifying a polymer containing pendant amine functions, with the help of a sulphuric electrophile compound, preferably a sultone (propanesultone, butanesultone), or a halogenoalkylsulphonate.

Some synthesis examples are given below:

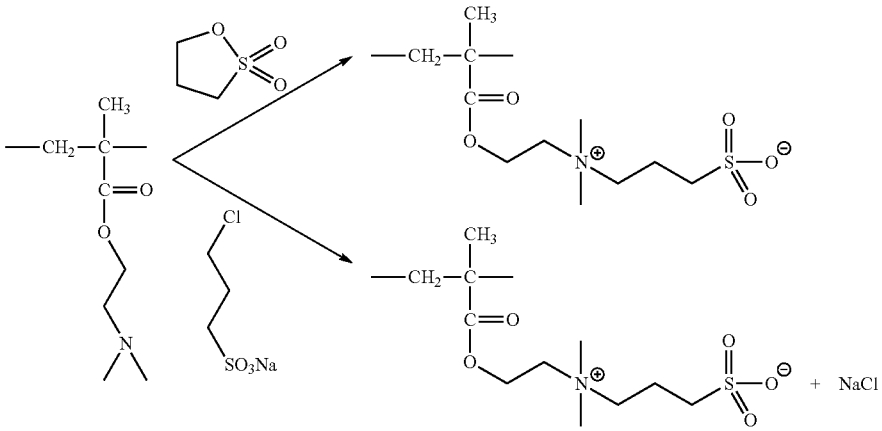

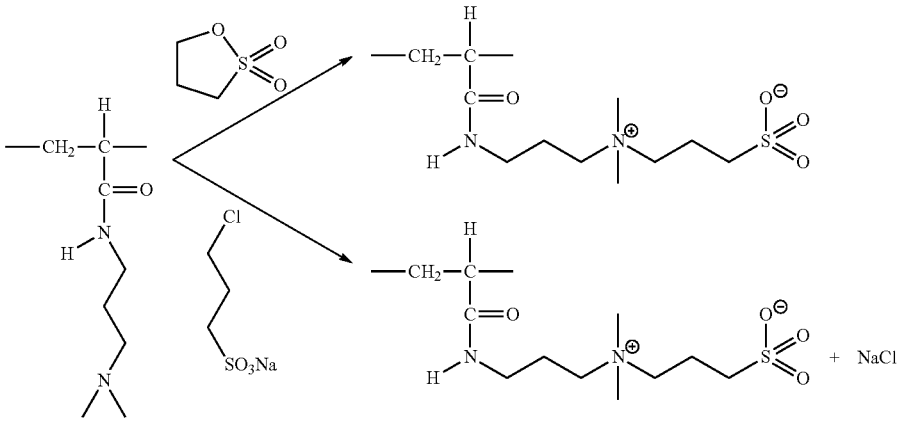

-continued

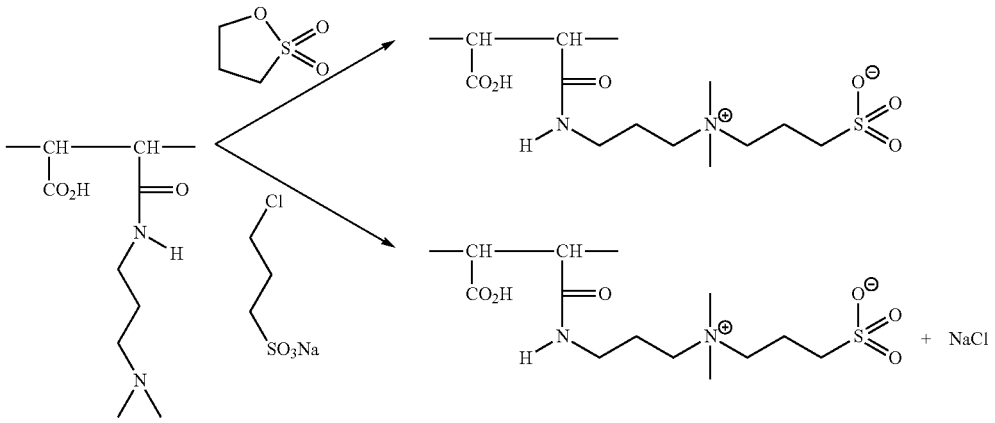

The main access paths through chemical modification of the precursor polymer by the sultones and the halogenoalkylsulphonates are described in the following documents:

"Synthesis and aqueous solution behavior of copolymers containing sulfobetaine moieties in side chains", I. V. Berlinova, I. V. Dimitrov, R. G. Kalinova, N. G. Vladimirov, Polymer 41, 831-837 (2000), "Poly(sulfobetaine)s and corresponding cationic polymers: 3. Synthesis and dilute aqueous solution properties of poly(sulfobetaine)s derived from styrene-maleic anhydride)", Wen-Fu Lee and Chun-Hsiung Lee, Polymer 38 (4), 971-979 (1997), "Poly(sulfobetaine)s and corresponding cationic polymers. VIII. Synthesis and aqueous solution properties of a cationic poly(methyl iodide quaternized styrene-N,N-dimethylaminopropyl maleamidic acid) copolymer", Lee, Wen-Fu; Chen, Yan-Ming, Journal of Applied Polymer Science 80, 1619-1626 (2001), "Synthesis of polybetaines with narrow molecular mass distribution and controlled architecture", Andrew B. Lowe, Norman C. Billingham and Steven P. Armes, Chem. Commun., 1555-1556 (1996), "Synthesis and Properties of Low-Polydispersity Poly(sulfopropylbetaine)s and Their Block Copolymers", Andrew B. Lowe, Norman C. Billingham, and Steven P. Armes, Macromolecules 32, 2141-2146 (1999), Japanese patent application published on 21 Dec. 1999, under number 11-349826.

According to a preferred embodiment, the units A (or polybetaine polymer herein) are selected from the group consisting of:

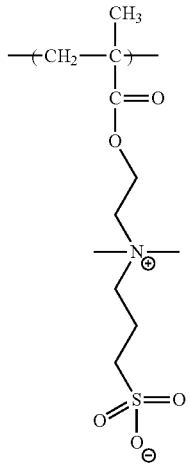

-(SPE)-

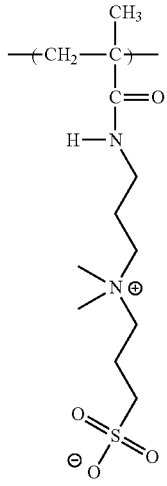

-(SPP)-

-continued

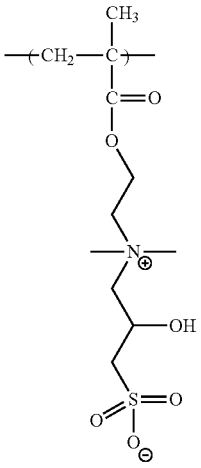

-(SHPE)-

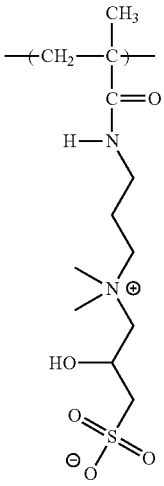

-(SHPP)-

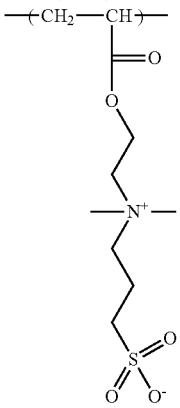

-(SPDA)-

Units B

The units B are optional and are preferably $C_3$-$C_8$ carboxylic, sulphonic, sulfuric, phosphonic or phosphoric acids with monoethylenic unsaturation, their anhydrides and their salts which are soluble in water and mixture thereof. Preferred units B are acrylic acid, methacrylic acid, α-ethacrylic acid, β,β-dimethylacrylic acid, methylenemalonic acid, vinylacetic acid, allylacetic acid, ethylidineacetic acid, propylidineacetic acid, crotonic acid, maleic acid, fumaric acid, itaconic acid, citraconic acid, mesaconic acid, N-(methacroyl)alanine, N-(acryloyl)hydroxyglycine, sulfopropyl acrylate, sulfoethyl acrylate, sulfoethyl methacrylate, styrenesulfonic acid, vinylsulfonic acid, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate, phosphonopropyl methacrylate and the alkali metal and ammonium salts thereof and mixtures thereof.

The polybetaine polymer according to the present invention may comprise additional optional units $C_{other}$, different from units A and B, if present, mentioned herein above. Units A and B, if present, may represent 1% to 100%, preferably 50 to 100%, preferably 75 to 100% in moles of the total copolymer units.

According to one preferred embodiment herein, the polybetaine polymer according to the present invention comprises:

70 to 99% in moles of units A, and 1 to 30% in moles of units B.

In a preferred embodiment, the polybetaine herein comprises less than 70 mol %, preferably less than 50 mol %, more preferably less than 30 mol % of units B and C (if present).

As stated above, the polybetaine polymer herein may contain for units $C_{other}$:

non-ionic, hydrophilic or hydrophobic $C_N$ units.

According to a preferred embodiment herein the polybetaine polymer herein does not comprise more than 25% in moles for the total of such units $C_{other}$, if present at all, preferably none at all. According to a preferred embodiment herein the polybetaine polymer herein does not comprise more than 25% in moles for the total $C_N$ units, preferably none at all.

According to a preferred embodiment herein the copolymer herein is substantially devoid (i.e., it comprises less than 1% in moles, preferably less than 0.5%, preferably none at all) of the following units:

$C_N$ units chosen from alkoxylated units with the following formula:

$$—CH_2—CHR^6[—X^2—(CH_2—CH_2—O)_n—R^7]—$$

wherein:

$R^6$ is a hydrogen atom or a methyl group, $X^2$ is a group with the formula —CO—O—, —CO—NH— or —$C_6H_4$—$CH_2$— n is the entire or average number greater than or equal to 1, $R^7$ is a hydrogen atom, an alkyl group or a tristyrylphenyl group, and/or hydroxyl units with the following formula:

$$—CH_2—CHR^6[—X^2—R^8]—$$

wherein:

$R^6$ is a hydrogen atom or a methyl group, $X^2$ is a group with the formula —CO—O—, —CO—NH— or —$C_6H_4$—$CH_2$—

$R^8$ is a hydrocarbon group with at least two carbon atoms, comprising at least 2 —OH groups, preferably on two consecutive carbon atoms, and/or hydroxyalkyl acrylate or methacrylate units.

hydrophobic $C_N$ units.

Preferred optional units C include acrylamide, vinyl alcohol, $C_1$-$C_4$ alkyl esters of acrylic acid and of methacrylic acid, $C_1$-$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters, esters of acrylic acid or of methacrylic acid and of polyethylene glycol or polypropylene glycol $C_1$-$C_{25}$ monoalkyl ethers, vinyl acetate, vinylpyrrolidone or methyl vinyl ether and mixtures thereof.

It is understood that the polybetaine polymer herein may be in any practical form, for example in solid or dry form, or for example in the form of a solution, emulsion, suspension or dispersion, namely in the form of an aqueous solution. The solution, emulsion, suspension or dispersion form, for example, the aqueous solution, may comprise 5 to 50% in the copolymer weight, for example 10 to 30% in weight. The aqueous solution may, in fact, be a solution obtained by a preparation process in an aqueous phase, namely a radical polymerisation process.

The polybetaine herein may have a molar mass going from 5000 g/mol to 3 000 000 g/mol, preferably from 8000 to 1 000 000 g/mol, more preferably from 10 000 to 500 000 g/mol.

Polybetaine Polymer Preparation Process

The polybetaine polymer according to the present may be prepared by any suitable process. The process generally involves a radical polymerisation (copolymerization) step, where monomers and a free radicals source are introduced.

According to a preferred embodiment herein, $A_{precursor}$ units are polymerized in the presence of a free radicals source to obtain a polybetaine polymer comprising units deriving from the $A_{precursor}$ units. These units are then chemically modified to obtain units A (post polymerisation modification) . The modifications are mentioned above, in the section detailing the A units.

According to another preferred embodiment herein, the process involves a polymerization step by introducing:

- a monomer A (or $A_{precursor}$) or a mixture thereof, comprising an ethylenically unsaturated group and a sulphobetaine group, and
- a free radicals source.

Such radical polymerisation processes are known in the art and by the skilled person. It is possible to vary, in particular, the free radicals source, the amount of free radicals, the phases for introducing the different compounds (monomers, free radicals source etc. . . . ), the polymerisation temperature, and other operating parameters or conditions in a known and suitable way. Some details and instructions are provided herein below.

The processes may be discontinuous ("batch"), semi-continuous ("semi-batch") or even continuous. A semi-continuous process typically involves a phase of progressive introduction of at least one monomer (co-monomer), preferably all monomers (co-monomers) into a reactor, without continuously removing the reaction product. This product, containing the polymer, is collected all at once after the reaction.

Advantageously, polymerisation can be done in an aqueous solution.

Any free radicals source may be used. Free radicals can be generated spontaneously, for example by raising the temperature, with suitable monomers like styrene. Free radicals can be generated by irradiation, namely UV irradiation, preferably in the presence of suitable initiators sensitive to UV. Initiators (or "igniters") or redox or radical initiator systems can be used. The free radicals source can be water-soluble or non water-soluble. Preferably water-soluble, or at least partially water-soluble, initiators (for example water-soluble to at least 50% in weight) are used.

Generally, the greater the amount of free radicals, the easier it is to initiate polymerisation (which is preferred), but the lower the molecular masses of the copolymers obtained.

It is possible to use the following initiators:

- hydrogen peroxides, such as: 3-butyl hydroperoxide, cumene hydroperoxide, -t-butyl-peroxyacetate, t-butylperoxybenzoate, t-butylperoxyoctoate, t-butylperoxyneodecanoate, t-butylperoxyisobutarate, lauroyl peroxide, t-amylperoxypivalte, t-butylperoxypivalate, dicumyl peroxide, benzoyl peroxide, potassium persulphate, ammonium persulphate,
- azo compounds, such as: 2-2'-azobis(isobutyronitrile), 2,2'-azobis(2-butanenitrile), 4,4'-azobis(4-pentanoic acid), 1,1'-azobis(cyclohexane-carbonitrile), 2-(t-butylazo)-2-cyanopropane, 2,2'-azobis[2-methyl-N-(1,1)-bis(hydroxymethyl)-2-hydroxyethyl]propionamide, 2,2'-azobis(2-methyl-N-hydroxyethyl]-propionamide, 2,2'-azobis(N,N'-dimethyleneisobutyramidine)dichloride, 2,2'-azobis(2-amidinopropane)dichloride, 2,2'-azobis(N,N'-dimethyleneisobutyramide), 2,2'-azobis(2-methyl-N-[1,1-bis(hydroxymethyl)-2-hydroxyethyl] propionamide), 2,2'-azobis(2-methyl-N-[1,1-bis (hydroxymethyl)ethyl]propionamide), 2,2'-azobis[2-methyl-N-(2-hydroxyethyl) propionamide], 2,2'-azobis (isobutyramide)dihydrate,
- redox systems containing combinations such as:
- mixtures of hydrogen or alkyl peroxide, peresters, percarbonates and similar, and any of the iron salts, titanium salts, zinc formaldehyde sulphoxylate or sodium formaldehyde sulphoxylate, and reducing sugars,
- persulphates, perborates or perchlorates of alkaline metals or ammonium in association with a alkaline metal bisulphite, such as sodium metabisulphite, and reducing sugars, and
- alkaline metal persulphates in association with an arylphosphinic acid, such as benzene phosphonic acid and similar, and reducing sugars.

The polymerisation temperature may be between 25° C. and 95° C. and may depend on the free radicals source. If it does not involve a UV initiator source, it is preferable to operate between 50° C. and 95° C., more preferably between 60° C. and 80° C. In general, the higher the temperature, the easier it is to initiate polymerisation (which is preferred), but the lower the molecular masses of the copolymers obtained.

In the composition of the present invention, the polybetaine polymer herein is preferably present at a level of from 0.001% to 5%, more preferably from 0.001% to 0.5%, most preferably from 0.001% to 0.01% by weight of the hard surface cleaning composition.

Vinlpyrrolidone Homopolymer or Copolymer

The compositions of the present invention additionally comprise a vinylpyrrolidone homopolymer or copolymer, or a mixture thereof. Typically, the compositions of the present invention may comprise from 0.001% to 5% by weight of the total composition of a vinylpyrrolidone homopolymer or copolymer, or a mixture thereof, more preferably from 0.005% to 1% and most preferably from 0.01% to 0.5%.

Suitable vinylpyrrolidone homopolymers for use herein are homopolymers of N-vinylpyrrolidone having the following repeating monomer:

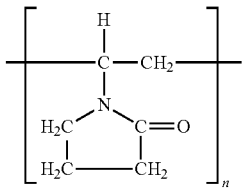

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include Sokalan HP 165®, Sokalan HP 12®, Luviskol K30®, Luviskol K60®, Luviskol K80®, Luviskol K90®; vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well known monomers may be used.

For example particularly suitable N-vinylimidazole N-vinylpyrrolidone polymers for use herein have an average molecular weight range from 5,000 to 1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name Luviskol® series from BASF.

According to a very preferred execution of the present invention, vinylpyrrolidone homopolymers are advantageously selected.

The polybetaine polymer herein and the vinylpyrrolidone homopolymer or copolymer herein are present in said composition at a weight ratio of polybetaine polymer to vinylpyrrolidone homopolymer or copolymer of at utmost 1.5:1, preferably from 1:25 to 1:1, more preferably from 1:20 to 1:1.5, even more preferably from 1:19 to 1:5, and still more preferably from 1:12 to 1:4 and most preferably 1:10 to 1:8.

It has been found that the presence of the specific combination of the polybetaine polymer herein and a vinylpyrrolidone homopolymer or copolymer used at the claimed weight ratio in a hard surface cleaning composition used to clean a hard surface allows to provide improved shine performance as compared to the use in the same hard surface cleaning application of a composition that is free of the polymer combination herein or only contains the vinylpyrrolidone homopolymer or copolymer. Furthermore, it has been found that the presence of the specific combination of the polybetaine polymer herein and a vinylpyrrolidone homopolymer or copolymer used at the claimed weight ratio in a hard surface cleaning composition used to clean a hard surface allows to provide improved soil repellency properties to the hard surface after an initial cleaning operation with the compositions according to the present invention as compared to the use in the same hard surface cleaning application of a composition that is free of the polymer combination herein or only contains the vinylpyrrolidone homopolymer or copolymer. Moreover, it has been found that the presence of the specific combination of the polybetaine polymer herein and a vinylpyrrolidone homopolymer or copolymer used at the claimed weight ratio in a hard surface cleaning composition used to clean a hard surface allows to provide improved next time cleaning benefit properties to the hard surface after an initial cleaning operation with the compositions according to the present invention as compared to the use in the same hard surface cleaning application of a composition that is free of the polymer combination herein or only contains the vinylpyrrolidone homopolymer or copolymer. In addition, it has been found that the presence of the specific combination of the polybetaine polymer herein and a vinylpyrrolidone homopolymer or copolymer used at the claimed weight ratio in a hard surface cleaning composition used to clean a hard surface allows to provide fast-drying benefit properties on inclined or vertical surfaces as compared to the use in the same hard surface cleaning application of a composition that is free of the polymer combination herein or only contains the polybetaine polymer herein.

It has surprisingly been found that on a hard surface initially cleaned with the hard surface cleaning compositions herein using, soils deposition is reduced or even prevented. Indeed, so-called soil repellency properties are observed. In addition, it has surprisingly been found that on a hard surface initially cleaned with the hard surface cleaning compositions herein, a next time cleaning benefit is observed. Indeed, subsequent cleaning operations of an initially cleaned surface are facilitated. Furthermore, it has surprisingly been found that the specific combination of the polybetaine polymer herein and a vinylpyrrolidone homopolymer or copolymer used at the claimed weight ratio in a hard surface cleaning composition used to clean a hard surface provides fast-drying benefit properties on inclined or vertical surfaces.

Therefore, in one embodiment, the present invention encompasses the use of a polybetaine polymer, wherein said polybetaine polymer comprises a zwitterionic unit A or a mixture thereof, wherein said unit A comprises a betaine group or a mixture thereof and wherein said betaine group of said unit A is a sulphobetaine group or a mixture thereof, and a vinylpyrrolidone homopolymer or copolymer, in a hard surface cleaning composition, wherein good shine and/or good soil repellency and/or good next time cleaning benefit are provided whilst also a good fast-drying performance on inclined or vertical surfaces is achieved.

It has been found that the soil repellence benefit and/or the next time cleaning benefit as described herein, is particularly beneficial on greasy soap scum soils that are mostly observed in a bathroom environment (e.g., as residues in bathtubs or shower stalls). Therefore, in one highly preferred embodiment according to the present invention, the hard surface cleaning composition herein is an acidic to neutral, preferably acidic, hard surface cleaning composition, preferably used to clean bathroom hard surfaces (as described herein above). The preferred pH range and bathroom hard surfaces also apply to the claimed use, as described herein above.

Drying Time and Shine Test Method

The drying time and shine performance is evaluated using the following test method:

3 ml of hard surface cleaning composition to be assessed is applied neat onto black glossy ceramic tiles (20*25 cm each), followed by wiping with a damped Sponge (e.g., Boma®) (4 cm by 9 cm) to spread the composition uniformly. The composition is left to act for 15 seconds, and then the tile (in vertical position) is rinsed with tap water for 30 second (water flow approx. 4 liters per minute). The tile is left to dry vertically at constant temperature (22° C.) and constant humidity (30-40% rH). The drying time is measured from the stop of the rinsing until the tile is observed to be completely dry (reported in sec).

The shine performance of the composition can be assessed by visual grading. To assess the shine performance of the given composition a PSU-scale ranging from 0, meaning a meaning a shine impression (i.e., excellent shine) of the given composition, to 6, poor shine impression (i.e., no shine) of the given composition, can be applied.

Additionally a gloss measurement @ 60° can be performed with a gloss meter (BYK Gardner) on six independent places on the tile and record average measurement and the standard deviation.

Long Lasting Shine Test Method

The long lasting performance is evaluated using the following test method:

3 ml of hard surface cleaning composition to be assessed is applied neat onto black glossy ceramic tiles (20*25 cm each), followed by wiping with a damped Sponge (e.g., Boma®) (4 cm by 9 cm) to spread the composition uniformly. The composition is left to act for 15 seconds, and then the tile (in vertical position) is rinsed with tap water for 30 second (water flow approx. 4 liters per minute). The tile is left to dry vertically at constant temperature (22° C.) and constant humidity (30-40% rH).

After completely dry, the vertical tile is sprayed on with 5 ml of a 0.1% soapy water solution (IVORY® soap) and let for 30 sec to run off the tile. After that, a 15 sec rinse step with water is performed (water flow approx. 4 liters per minute) and the tile is left to dry in vertical position. The cycle of applying soapy water, rinsing and drying is repeated nine times.

Visual grading and a gloss measurement are performed as mentioned in the above test method long lasting shine against watermarks every second application of soapy water, rinsing a drying cycle (cycles 1-3-5-7-9).

Soil Repellency and Next Time Cleaning Benefit Test Method

The next time cleaning/soil repellency performance of a hard surface cleaning composition is evaluated using the following tests method:

2 ml of hard surface cleaning composition to be assessed is applied neat onto a clean black glossy ceramic tiles (20*25 cm each), followed by wiping lightly with a damped Sponge (e.g., Boma®) (4 cm by 9 cm) to spread the product uniformly. The product is left to act for 30 seconds, and then the tile (in vertical position) is rinsed with tap water for 30 second (water flow approx. 4 liters per minute). The tile is left to dry vertically at constant temperature (22° C.) and constant humidity (30-40% rH) until completely dry.

Prepare a soil composition of body soil, inorganic and organic particles and calcium stearate and spray onto the tile at 0.025-0.030 grams soil on a surface of 2.5 cm by 7 cm. Let the soil dry for 2 hours. Place the tile vertical and apply water using a shower head from approx. 5 cm above the soil stain with a water flow of 9 lt./minute. The time is measured until complete removal of the stain. After 5 minutes (if the stain is not 100% removed) a visual assessment of % stain removal is requested.

Optional Composition Ingredients

The hard surface cleaning compositions according to the present invention may comprise a variety of optional ingredients depending on the technical benefit aimed for and the surface treated.

Suitable optional ingredients for use herein include surfactants, builders, chelants, polymers, buffers, bactericides, preservatives, hydrotropes, colorants, stabilisers, radical scavengers, bleaches, bleach activators, enzymes, soil suspenders, dye transfer agents, brighteners, anti dusting agents, dispersants, dye transfer inhibitors, pigments, silicones, perfumes and/or dyes.

Surfactants

The compositions herein may comprise a nonionic, anionic, zwitterionic and amphoteric surfactant or mixtures thereof. Said surfactant is preferably present at a level of from 0.01% to 20% of composition herein. Suitable surfactants are those selected from the group consisting of nonionic, anionic, zwitterionic and amphoteric surfactants, having hydrophobic chains containing from 8 to 18 carbon atoms. Examples of suitable surfactants are described in McCutcheon's Vol. 1: Emulsifiers and Detergents, North American Ed., McCutcheon Division, MC Publishing Co., 2002.

Preferably, the hard surface cleaning composition herein comprises from 0.01% to 20%, more preferably from 0.5% to 10%, and most preferably from 1% to 5% by weight of the total composition of a surfactant or a mixture thereof.

Non-ionic surfactants are highly preferred for use in the compositions of the present invention. Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Preferably, the aqueous compositions comprise from 0.01% to 20%, more preferably from 0.5% to 10%, and most preferably from 1% to 5% by weight of the total composition of a non-ionic surfactant or a mixture thereof.

A preferred class of non-ionic surfactants suitable for the present invention is alkyl ethoxylates. The alkyl ethoxylates of the present invention are either linear or branched, and contain from 8 carbon atoms to 16 carbon atoms in the hydrophobic tail, and from 3 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 12 carbon atoms in the hydrophobic tail, and from 4 to 9 oxide units in the hydrophilic head group. A most preferred alkyl ethoxylate is $C_{9-11}$ $EO_5$, available from the Shell Chemical Company under the tradename Neodol 9°-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79®.

Another class of non-ionic surfactant suitable for the present invention is alkyl polysaccharides. Such surfactants are disclosed in U.S. Pat. Nos. 4,565,647, 5,776,872, 5,883,062, and 5,906,973. Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from 8 to 16 carbon atoms, with an average chain length of 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany).

Another class of non-ionic surfactant suitable for the present invention is amine oxide. Amine oxides, particularly those comprising from 10 carbon atoms to 16 carbon atoms in the hydrophobic tail, are beneficial because of their strong cleaning profile and effectiveness even at levels below 0.10%. Additionally $C_{10-16}$ amine oxides, especially $C_{12}$-$C_{14}$ amine oxides are excellent solubilizers of perfume. Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

Also suitable for use in the present invention are the fluorinated nonionic surfactants. One particularly suitable fluorinated nonionic surfactant is Fluorad F170 (3M Corporation, 3M Center, St. Paul, Minn., USA). Fluorad F170 has the formula $C_8F_{17}SO_2N(CH_2—CH_3)(CH_2CH_2O)_x$. Also suitable for use in the present invention are silicon-based surfactants. One example of these types of surfactants is Silwet L7604 available from Dow Chemical (1691 N. Swede Road, Midland, Mich., USA).

The condensation products of ethylene oxide with a hydrophobic base formed by the condensation of propylene oxide with propylene glycol are also suitable for use herein. The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other non-ionic surfactants that can be used include those derived from natural sources such as sugars and include $C_8$-$C_{16}$ N-alkyl glucose amide surfactants.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$-$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

An example of a $C_{14}$-$C_{16}$ alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3—(CH_2)_m—CH(CH_2OSO_3Na)—(CH_2)_n—CH_3$ where n+m=8-9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$-$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}$E(1.0)SM), $C_{12}$-$C_{18}$ alkyl polyethoxylate (2.25) sulfate ($C_{12}$-$C_{18}$E(2.25)SM), $C_{12}$-$C_{18}$ alkyl polyethoxylate (3.0) sulfate ($C_{12}$-$C_{18}$E(3.0)SM), and $C_{12}$-$C_{18}$ alkyl polyethoxylate (4.0) sulfate ($C_{12}$-$C_{18}$E(4.0)SM), wherein M is conveniently selected from sodium and potassium.

Suitable $C_6$-$C_{20}$ alkyl alkoxylated linear or branched diphenyl oxide disulphonate surfactants for use herein are according to the following formula:

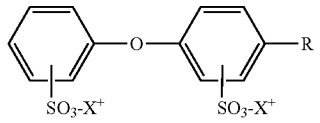

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the C12 branched di phenyl oxide disulphonic acid and C16 linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO\text{-}M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic surfactants represent another class of preferred surfactants within the context of the present invention.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082.

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants. One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

Chelating Agents

One class of optional compounds for use herein includes chelating agents or mixtures thereof. Chelating agents can be incorporated in the compositions herein in amounts ranging from 0.0% to 10.0% by weight of the total composition, preferably 0.01% to 5.0%.

Suitable phosphonate chelating agents for use herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Fatty Acid

The hard surface cleaning compositions of the present invention may comprise a fatty acid, or mixtures thereof as an optional ingredient.

Suitable fatty acids for use herein are the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil.

For example Coconut Fatty Acid is commercially available from UNICHEMA under the name PRIFAC 5900®.

Fatty acids are desired herein as they reduce the sudsing of the composition according to the present invention.

Typically, the hard surface cleaning composition herein may comprise up to 6%, preferably from 0.1% to 2.0%, more preferably from 0.1% to 1.0% and most preferably from 0.2% to 0.8% by weight of the total composition of said fatty acid.

Branched Fatty Alcohol

The hard surface cleaning composition of the present invention may comprise a branched fatty alcohol, or mixtures thereof as a highly preferred optional ingredient.

Such suitable compounds are commercially available, for instance, as the Isofol® series such as Isofol® 12 (2-butyl octanol) or Isofol® 16 (2-hexyl decanol) commercially available from Condea.

Preferably said branched fatty alcohol is selected from the group consisting of 2-butyl octanol, 2-hexyl decanol, and a mixture thereof. More preferably said 2-alkyl alkanol is 2-butyl octanol.

Typically, the hard surface cleaning composition herein may comprise up to 2%, preferably from 0.10% to 1.0%, more preferably from 0.1% to 0.8% and most preferably from 0.1% to 0.5% by weight of the total composition of said branched fatty alcohol.

Solvent

The hard surface cleaning compositions, preferably the liquid hard surface cleaning composition, of the present invention may comprise a solvent, or mixtures thereof as an optional ingredient.

Suitable solvent is selected from the group consisting of: ethers and diethers having from 4 to 14 carbon atoms, preferably from 6 to 12 carbon atoms, and more preferably from 8 to 10 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

Suitable glycols to be used herein are according to the formula HO—$CR_1R_2$—OH wherein $R_1$ and $R_2$ are independently H or a $C_2$-$C_{10}$ saturated or unsaturated aliphatic hydrocarbon chain and/or cyclic. Suitable glycols to be used herein are dodecaneglycol and/or propanediol.

Suitable alkoxylated glycols to be used herein are according to the formula R-$(A)_n$-$R_1$—OH wherein R is H, OH, a linear or branched, saturated or unsaturated alkyl of from 1 to 20 carbon atoms, preferably from 2 to 15 and more preferably from 2 to 10, wherein $R_1$ is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula R-$(A)_n$-OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable alkoxylated aliphatic alcohols to be used herein are according to the formula R-$(A)_n$-OH wherein R is a linear or branched, saturated or unsaturated alkyl group of from 1 to 20 carbon atoms, preferably from 2 to 15 and more preferably from 3 to 12, wherein A is an alkoxy group preferably butoxy, propoxy and/or ethoxy, and n is an integer of from 1 to 5, preferably 1 to 2. Suitable alkoxylated aliphatic linear or branched alcohols are butoxy propoxy propanol (n-BPP), butoxyethanol, butoxypropanol (n-BP), ethoxyethanol, 1-methylpropoxyethanol, 2-methylbutoxyethanol, or mixtures thereof. Butoxy propoxy propanol is commercially available under the trade name n-BPP® from Dow chemical. Butoxypropanol is commercially available from Dow chemical.

Suitable aliphatic alcohols to be used herein are according to the formula R—OH wherein R is a linear or branched, saturated or unsaturated alkyl group of from 1 to 20 carbon atoms, preferably from 2 to 15 and more preferably from 5 to 12. With the proviso that said aliphatic branched alcohols is not a 2-alkyl alkanol as described herein above. Suitable aliphatic alcohols are methanol, ethanol, propanol, isopropanol or mixtures thereof.

Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Other suitable solvents include butyl diglycol ether (BDGE), hexandiols, butyltriglycol ether, ter amilic alcohol and the like. BDGE is commercially available from Union Carbide or from BASF under the trade name Butyl CARBITOL®.

Preferably said solvent is selected from the group consisting of butoxy propoxy propanol, butyl diglycol ether, benzyl alcohol, butoxypropanol, ethanol, methanol, isopropanol, hexandiols and mixtures thereof. More preferably said solvent is selected from the group consisting of butoxy propoxy propanol, butyl diglycol ether, benzyl alcohol, butoxypropanol, ethanol, methanol, isopropanol and mixtures thereof. Even more preferably said solvent is selected from the group consisting of butyl diglycol ether, butoxypropanol, ethanol and mixtures thereof.

Typically, the hard surface cleaning composition herein may comprise up to 30%, preferably from 1% to 25%, more preferably from 1% to 20% and most preferably from 2% to 10% by weight of the total composition of said solvent or mixture thereof.

In a preferred embodiment the solvent comprised in the hard surface cleaning composition according to the present invention is a volatile solvent or a mixture thereof, preferably a volatile solvent or a mixture thereof in combination with another solvent or a mixture thereof.

Perfumes

The hard surface cleaning compositions of the present invention may comprise a perfume or a mixture thereof as a highly preferred optional ingredient.

Suitable perfumes for use herein include materials which provide an olfactory aesthetic benefit and/or cover any "chemical" odor that the product may have.

The compositions herein may comprise a perfume or a mixture thereof, in amounts up to 5.0%, preferably in amounts of 0.01% to 2.0%, more preferably in amounts of 0.05% to 1.5%, even more preferably in amounts of 0.1% to 1.0%, by weight of the total composition.

Builders

The hard surface cleaning compositions of the present invention may also comprise a builder or a mixture thereof, as an optional ingredient.

Suitable builders for use herein include polycarboxylates and polyphosphates, and salts thereof. Typically, the compositions of the present invention comprise up to 20.0% by weight of the total composition of a builder or mixtures thereof, preferably from 0.1% to 10.0%, and more preferably from 0.5% to 5.0%.

Radical Scavenger

The compositions of the present invention may comprise a radical scavenger.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers when used, are typically present herein in amounts up to 10% and preferably from 0.001% to 0.5% by weight of the total composition.

The presence of radical scavengers may contribute to the chemical stability of the compositions of the present invention.

Other Adjuvants

Non-limiting examples of other adjuncts are: enzymes such as proteases, hydrotropes such as sodium toluene sulfonate, sodium cumene sulfonate and potassium xylene sulfonate, and aesthetic-enhancing ingredients such as colorants, providing they do not adversely impact on filming/streaking. The compositions can also comprise one or more colored dyes or pigments. Dyes, pigments and disappearing dyes, if present, will constitute from 0.1 ppm to 50 ppm by weight of the aqueous composition.

Packaging Form of the Compositions

The compositions herein may be packaged in a variety of suitable detergent packaging known to those skilled in the art. The liquid compositions are preferably packaged in conventional detergent plastic bottles.

EXAMPLES

Example 1

Preparation of Polybetaine Polymer

Example 1.1

A Polybetaine Polymer of 100% Moles of SPE 32.2 g of water are added to a 500 mL glass three-necked flask, equipped with a shaking mechanism, a coolant and a temperature regulator with an oil bath. With nitrogen flushing, the temperature of the reactive environment is brought to 75° C. At 75° C., 0.11 g of 2,2'-azobis(2-methylpropionamidine) dichloride dissolved in 0.6 g of water is added. A solution, 100 g of SPE (as described herein above) and 195 g of water, and another solution containing 1 g of 2,2'-azobis(2-methylpropionamidine) dihydrochloride and 20 g of water are then simultaneously added over 4 and 5 hours respectively. After these additions, shaking and the temperature are maintained over 4 hours. The reactive environment is then cooled to room temperature.

Example 2

Hard Surface Cleaning Compositions

The following examples are meant to exemplify hard surface cleaning compositions according to the present invention, preferably used in a process of cleaning a hard surface according to the present invention but are not intended to limit the scope of the present invention. The hard surface cleaning compositions below are made by combining the listed ingredients in the order given using the listed proportions to form homogenous mixtures (solution % is by weight of active material).

| | Composition | | | | | | |
|---|---|---|---|---|---|---|---|
| | A | B | C | D | E | F | G |
| Alkoxylated nonionic surfactants | | | | | | | |
| C9-11 EO5 | 4.5 | — | 9.0 | 4.0 | 3.0 | — | — |
| C12-14 EO5 | 1.5 | — | — | 6.0 | 0.5 | 0.7 | — |
| C10 AO7 | — | 3.5 | — | — | — | — | 3.0 |
| C9-11 EO8 | — | — | — | 2.0 | — | — | — |
| Anionic surfactants | | | | | | | |
| NaLAS | 0.5 | 0.2 | 0.4 | 1.5 | 0.2 | — | 0.5 |
| Sulphated Safol 23 ® | — | — | — | — | — | 0.4 | — |
| NaCS | 1.5 | 0.7 | 1.7 | 3.0 | 1.4 | 0.8 | 0.8 |
| Neutralizing co-surfactants | | | | | | | |
| C12-14 AO | 0.2 | — | — | — | 0.1 | 0.5 | — |
| Polymers | | | | | | | |
| Poly SPE polymer | 0.02 | 0.01 | 0.02 | 0.05 | 0.005 | 0.015 | 0.01 |
| PVP | 0.08 | 0.09 | 0.13 | 0.10 | 0.045 | 0.060 | 0.09 |
| Kelzan T ® | — | — | — | — | — | — | — |
| Chelants | | | | | | | |
| DTPMP | 0.1 | 0.1 | 0.2 | — | 0.15 | — | 0.1 |
| Buffer | | | | | | | |
| $Na_2CO_3$ | 0.2 | 0.4 | 1.0 | 1.0 | 0.6 | — | 0.5 |
| Citric | 1.0 | — | 0.8 | 0.7 | 0.5 | 1.0 | — |
| Caustic | 0.8 | — | 0.3 | 0.4 | 0.3 | 0.7 | — |
| Suds control | | | | | | | |
| Fatty Acid | 0.8 | 0.3 | 0.3 | 0.2 | 0.2 | 0.3 | 0.2 |
| Isofol 12 ® | — | — | — | 0.5 | — | — | — |
| Solvents | | | | | | | |
| EtOH | — | — | — | — | — | — | 1.0 |
| n-BP | — | — | — | — | — | 5.5 | 3.0 |
| MEA | — | — | — | — | — | 0.7 | — |
| Minors and water | | | | up to 100 | | | |
| pH | 9.5 | 9.5 | 9.5 | 9.5 | 10.0 | 11.0 | 9.5 |

| | Composition | | | | | | |
|---|---|---|---|---|---|---|---|
| | H | I | J | K | L | M | N |
| Alkoxylated nonionic surfactants | | | | | | | |
| C9-11 EO8 | 0.45 | 0.45 | 0.5 | 2.0 | 2.2 | 2.2 | 2.2 |
| Anionic surfactants | | | | | | | |
| NaLAS | — | — | — | 0.5 | — | — | — |
| Sulphated Safol 23 ® | 1.8 | 1.8 | 2.0 | — | — | — | — |
| NaCS | — | — | — | 0.5 | — | — | — |
| Polymers | | | | | | | |
| Poly SPE polymer | 0.005 | 0.01 | 0.1 | 0.025 | 0.01 | 0.05 | 0.025 |

-continued

| | Composition | | | | | | |
|---|---|---|---|---|---|---|---|
| | H | I | J | K | L | M | N |
| Kelzan T ® | 0.3 | 0.1 | 0.3 | 0.2 | 0.3 | 0.2 | 0.2 |
| PVP | 0.045 | 0.09 | 0.1 | 0.075 | 0.09 | 0.05 | 0.075 |
| Chelants | | | | | | | |
| DTPMP | — | — | 0.5 | — | 0.2 | 0.1 | — |
| Buffer | | | | | | | |
| Citric | 2.7 | 2.7 | 3.0 | 2.7 | — | — | — |
| Phosphoric | — | — | — | — | 9.0 | 6.0 | — |
| NaOH | 0.02 | 0.5 | — | — | 0.1 | 0.05 | 0.2 |
| KOH | 0.8 | — | 0.8 | 0.8 | — | — | — |
| Formic acid | — | — | — | — | — | — | 6.0 |
| Suds control | | | | | | | |
| Fatty Acid | — | 0.1 | — | 0.1 | — | — | — |
| Isofol 12 ® | — | 0.1 | 0.1 | — | — | — | — |
| Solvents | | | | | | | |
| EtOH | — | — | 0.5 | — | — | — | — |
| n-BP | — | 1.0 | 0.5 | — | — | — | — |
| n-BPP | 1.80 | 0.90 | 10 | 2.0 | — | — | — |
| Minors and water | | | | up to 100 | | | |
| pH | 3.6 | 3.6 | 3.5 | 4.0 | 0.8 | 0.8 | 2.2 |

Poly SPE polymer is a polybetaine polymer of 100% moles of SPE, as obtained from Example 1.1.

C9-11 EO5 is a C 9-11 EO5 nonionic surfactant commercially available from ICI or Shell.

C9-11 EO8 is a C 9-11 EO8 nonionic surfactant commercially available from ICI or Shell.

C12,14 EO5 is a C12, 14 EO5 nonionic surfactant commercially available from Huls, A&W or Hoechst.

C10 A07 is an alkoxylated non-ionic surfactant commercially available from BASF under the tradename Lutensol XL 70®.

NaLAS is Sodium Linear Alkylbenzene sulphonate commercially available from A&W.

NaCS is Sodium Cumene sulphonate commercially available from A&W.

Sulphated Safol 23® is a branched $C_{12-13}$ sulphate surfactant based on Safol 23, an alcohol commercially available from Sasol, which has been sulphated.

C12-14 AO is a C12-14 amine oxide surfactant available from Mcintyre

DTPMP is diethylenetriaminepentamethylphosphonic acid commercially available from Solutia.

Isofol 12® is 2-butyl octanol commercially available from Condea.

n-BP is normal butoxy propanol commercially available from Dow Chemicals.

n-BPP is normal butoxy propoxy propanol commercially available from Dow Chemicals.

Ethanol is commercially available from Condea.

MEA is mono-ethanolamine commercially available from Condea.

Kelzan T® is Xanthan gum available from Kelco.

PVP is a vinylpyrrolidone homopolymer, commercially available from ISP Corporation.

Fatty acid is a Coconut Fatty Acid.

Citric Acid is available from Jungbunzlauer.

KOH is available from Tessenderloo Chemie SA.

These hard surface cleaning compositions are used in a process as disclosed herein and provide good shine performance, when used in a hard surface cleaning application. In addition, when used in a hard surface cleaning application these hard surface cleaning compositions provide good soil repellency performance as well as good next time cleaning benefit performance. Furthermore, these hard surface cleaning compositions show good fast drying benefits on inclined or vertical hard surfaces.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Experimental Data

Composition i has been used as a basis for generating the Experimental Data. The hard surface cleaning composition below was made by combining the listed ingredients in the order given using the listed proportions to form homogenous mixtures (solution % is by weight of active material).

| | i |
|---|---|
| Alkoxylated nonionic surfactants | |
| C 9-11 EO8 | 0.45 |
| Anionic surfactants | |
| Sulphated Safol 23 ® | 1.8 |
| Polymers | |
| Poly SPE polymer | varies |
| PVP | varies |
| Buffer | |
| KOH | 0.8 |
| Citric | 2.70 |
| NaOH | 0.02 |
| Solvents | |
| n-BPP | 1.8 |
| Minors and water | — |
| pH | 3.6 |

List of Ingredients See Example Section

Different Poly SPE polymer (polybetaine polymer) and PVP (vinylpyrrolidone homopolymer) levels (as detailed in the below Table) in hard surface cleaning composition i have been tested for drying time and soil repellency. The test methods as detailed herein above have been used.

| Composition i plus | Drying time (sec) | Soil repellency test (sec) |
|---|---|---|
| 0% Poly SPE<br>0.05% PVP | 70 | 256 |
| 0.005% Poly SPE<br>0.045% PVP<br>(ratio of polybetaine:vinylpyrrolidone homopolymer of 1:9) | 70 | 118 |
| 0.05% Poly SPE<br>0% PVP | 910 | 97 |

The combination of Poly SPE polymer with PVP shows good soil repellency performance whilst at the same time showing a good fast-drying performance.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hard surface cleaning composition comprising a polybetaine homopolymer, wherein said polybetaine homopolymer comprises a zwitterionic unit A, wherein said unit A comprises a betaine group and wherein said betaine group of said unit A is a sulphobetaine group and a vinylpyrrolidone homopolymer, wherein said polybetaine homopolymer and said vinylpyrrolidone homopolymer are present in said composition at a weight ratio of polybetaine homopolymer to vinylpyrrolidone homopolymer of from about 1:10 to about 1:8, and wherein said unit A of said polybetaine homopolymer is selected from the group consisting of:

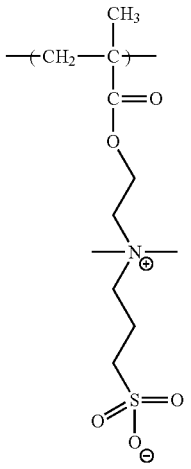

-(SPE)-

-continued

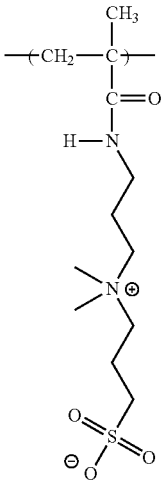

-(SPP)-

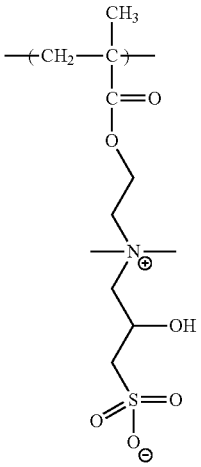

-(SHPE)-

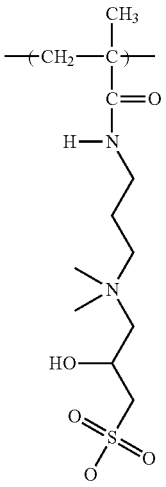

-(SHPP)-

-continued

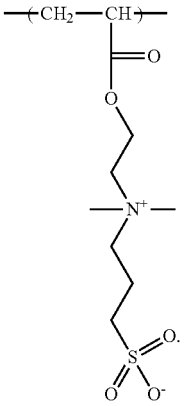

-(SPDA)-

2. A hard surface cleaning composition according to claim 1, wherein in said polybetaine polymer said betaine group of said unit A is a pendant group of said polybetaine homopolymer.

3. A hard surface cleaning composition according to claim 1, wherein said polybetaine homopolymer is obtainable by a copolymerization step by introducing:

a monomer A, containing an ethylenically unsaturated group and a sulphobetaine group, and a free radicals source.

4. A hard surface cleaning composition according to claim 1, wherein said polybetaine homopolymer is present at a level of from about 0.001% to about 5% of the total weight of said composition.

5. A hard surface cleaning composition according to claim 1, wherein said polybetaine homopolymer and said vinylpyrrolidone homopolymer are present in said composition at a weight ratio of polybetaine homopolymer to vinylpyrrolidone homopolymer or copolymer of from about 1:25 to about 1:1.

6. A hard surface cleaning composition according to claim 1, wherein said composition is a liquid hard surface cleaning composition.

7. A hard surface cleaning composition according to claim 1, wherein said composition is a liquid, acidic to neutral, preferably acidic, hard surface cleaning composition.

8. A pre-moistened hard surface cleaning wipe comprising a substrate, preferably a nonwoven substrate, impregnated with a hard surface cleaning composition according to claim 6.

9. A process of cleaning a hard surface with a hard surface cleaning composition according to claim 1 or a pre-moistened hard surface cleaning wipe according to claim 8.

* * * * *